US006644998B2

(12) United States Patent
Kaufmann et al.

(10) Patent No.: US 6,644,998 B2
(45) Date of Patent: Nov. 11, 2003

(54) ELECTRICAL CONNECTING ELEMENT

(75) Inventors: Ralf Kaufmann, Rangendingen (DE); Manfred Hoecherl, Herrischried (DE)

(73) Assignee: Jostra AG, Hirringen (DE)

( * ) Notice: Subject to any disclaimer, the term of this patent is extended or adjusted under 35 U.S.C. 154(b) by 0 days.

(21) Appl. No.: 10/213,254

(22) Filed: Aug. 6, 2002

(65) Prior Publication Data

US 2002/0197905 A1 Dec. 26, 2002

Related U.S. Application Data

(62) Division of application No. 09/838,416, filed on Apr. 19, 2001.

(30) Foreign Application Priority Data

Aug. 2, 2000 (DE) ..... 100 37 613

(51) Int. Cl.[7] ..... H01R 11/20; H01R 4/24

(52) U.S. Cl. ..... 439/412; 439/428; 439/784; 439/909

(58) Field of Search ..... 439/815, 412, 439/805, 893, 784, 863, 431, 433, 727, 357, 411, 415, 417, 738, 737, 750, 752, 397, 399, 901, 428, 429

(56) References Cited

U.S. PATENT DOCUMENTS

| | | | | | |
|---|---|---|---|---|---|
| 3,718,891 | A | * | 2/1973 | Wening | 439/727 |
| 5,538,439 | A | * | 7/1996 | Fell et al. | 439/357 |
| 5,620,339 | A | * | 4/1997 | Gray et al. | 439/784 |
| 5,989,056 | A | * | 11/1999 | Lange et al. | 439/412 |
| 6,364,690 | B1 | * | 4/2002 | Nehm-Engelberts | 439/412 |
| 6,422,884 | B1 | * | 7/2002 | Babasick et al. | 439/357 |
| 6,443,756 | B1 | * | 9/2002 | Hagmann et al. | 439/411 |

* cited by examiner

*Primary Examiner*—Renee Luebke
*Assistant Examiner*—Felix O. Figueroa
(74) *Attorney, Agent, or Firm*—Michael J. Striker

(57) ABSTRACT

An electrical connection element for connecting an electrically insulated end of a wire has a clamping sleeve in which an end of a wire is insertable and clampable, an insulation sleeve connectable with the clamping sleeve and provided with a connecting contact arranged so that, during a connection of the clamping sleeve with the insulation sleeve the connecting contact of the insulation sleeve is brought into contact with an end of a wire with removal of an insulation of the wire, and is then held there.

5 Claims, 6 Drawing Sheets

FIG. 3
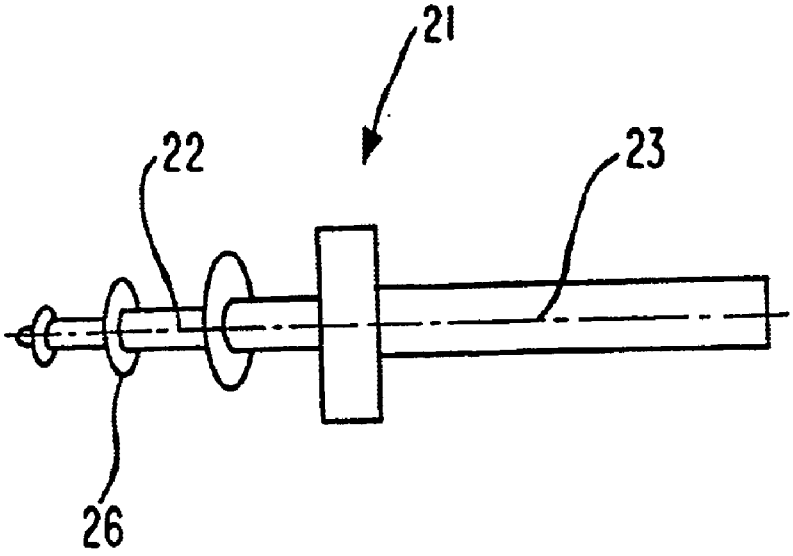
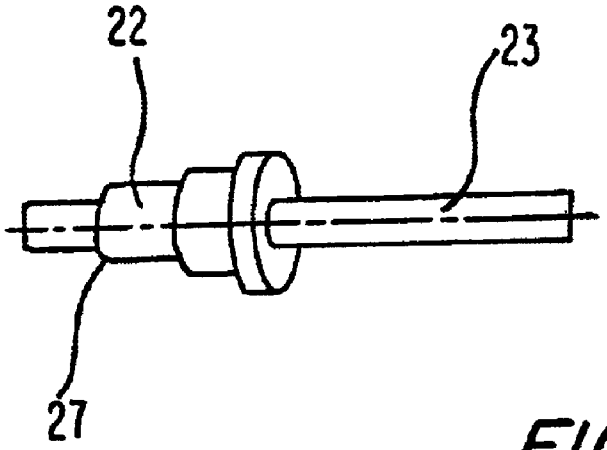
FIG. 4

ELECTRICAL CONNECTING ELEMENT

This appln is a Divisional of Ser. No. 09/838,416 filed Apr. 19, 2001.

BACKGROUND OF THE INVENTION

The present invention relates to an electrical connecting element.

More particularly it relates to an electrical connecting element which can be connected to an electrically insulated end of a wire, wherein the end of the wire during connection of the connecting element is simultaneously bared and reliably mounted in the connecting element.

For connections of connecting elements, such as bushing or electrical plugs, to an electrical wire, conventionally the end of the wire is bared and then connected by means of a clamping or screw connection with a connecting element. There are however applications in which during the process of connection of a connecting element to a wire, the wire to be bared must not be contacted. This is the case for example in the medical field, when for example an external heart pacemaker must be connected to the conductors which are connected with the heart muscles and extend out of the body. In this case the conductors which extend out of the body must not be contacted with its conductive core. A contact of the conductive core of the wire can cause an electrical discharge. Such an electrical discharge can lead to grave heart rhythm distortions up to a heart chamber flicker. In this particular case the connecting element must be connected to the slotted and further electrically insulated end of the wire without removing the insulation of the wire.

So-called clamping plugs are known in the prior art in particular from the company Multi-Contact AG, Basel, Switzerland. In these clamping plugs the insulated wire is clamped in a plug and simultaneously the insulation is removed. These plugs are however relatively expensive, susceptible to failures, voluminous and difficult to operate, since they contain a spring element and a pressure button. Moreover, diverse plug elements for bared wires are known as well.

SUMMARY OF THE INVENTION

Accordingly, it is an object of the present invention to provide an electrical connecting element for connection to an electrically insulated end of a wire, which avoids the disadvantages of the prior art.

More particularly, it is an object of present invention to provide an electrical connecting element for connection to an electrically insulated end of a wire, in which the wire before the connection must not be bared, which is easy to handle, and which has a small size and a simple construction.

In keeping with these objects and with others which will become apparent hereinafter, one feature of present invention resides, briefly stated, in an electrical connecting element having a clamping sleeve in which an end of the wire is insertable and clampable, and an insulation sleeve connected to the clamping sleeve and provided with a connecting contact, so that during connection of the clamping sleeve and the insulation sleeve, the connecting contact of the insulation sleeve is brought in contact with the end of the wire with maintaining of the insulation of the wire, and is held in this position.

When the electrical connecting element is designed in accordance with the present invention, it eliminates the disadvantages of the prior art and provides for the above mentioned advantages. The inventive electrical connecting element is composed of two parts including a so-called clamping sleeve and a so-called insulation sleeve which are connectable with one another. The electrically insulated end of the wire, to which the electrical connecting element must be connective, is first inserted in the clamping sleeve and then preliminarily clamped. For this purpose it can be inserted in a correspondingly formed passage of the clamping sleeve and firmly clamped there. Preferably, this passage is formed so that the end of the wire is inserted in a doubled force unloading loop and held in it.

The clamping sleeve and the insulation sleeve are formed so that, when they are connected with one another for example by screwing, the wire is clamped between them and its insulation eliminated, and a connection contact which is provided in the insulation sleeve is brought in electrical contact with the bared end of the wire.

For providing this clamping and simultaneous insulation removal of the wire end, the clamping sleeve has for example a recess with a diameter which expands toward the connection point. The recess is formed for example as a funnel. The end of the wire is inserted into the clamping sleeve preferably so far that the end of the wire is located substantially at the connecting point between the clamping sleeve and the insulation sleeve. The connecting contact of the insulation sleeve includes a forwardly reducing squeezing contact element, which is formed so that during connection of the clamping sleeve and the insulation sleeve it is forced into the recess of the clamping sleeve. Thereby the end of the wire located there is squeezed against the wall of the recess of the clamping sleeve.

The squeezing contact element can be formed in different ways with consideration of the above described deformation. It can be formed for example from the screw thread, from several disks arranged at a distance from one another and having a reducing diameter, or from several cylinders with a reducing diameter. It is important that during insertion of the squeezing contact element the end of the wire is not upset, but instead is reliably pressed against the wall of the recess of the clamping sleeve, and simultaneously the insulation is removed from the wire end. The outer edges of the squeezing contact element must be formed so sharp that they can remove the insulation of the wire end, but at the same time must not be too sharp that they can cut the wire strand. A further securing against separating of the wire strand is provided by a certain yieldability of the clamping sleeve material.

The connecting contact of the insulation sleeve, in addition to the squeezing contact element also advantageously has a connecting member which is electrically connected with the squeezing contact element. The connecting member can be formed for example as a plug pin or a plug bushing. A correspondingly shaped plug bushing or a plug pin can be connected with the thusly formed connecting member so that an electrical conductor and an electrical wire are connectable with the inventive connecting element. The plug pin or the plug bushing must be insulated from outside, so as to prevent the users contact with the bared wire.

Th clamping sleeve and the insulation sleeve can be connected with one another in a known manner. For example they can be provided for this purpose with matching screw threads or a connection device in form of bajonet lock or a louver lock connector.

The clamping sleeve and the insulation sleeve must be composed of an electrically insulating material. For this purpose for example an impact-resistant plastic which is not flowable at the corresponding application temperatures can be utilized. For the use in the medical field it is advantageous when a synthetic plastic or a similar material is selected so that, it can be easily sterilized for example in ethylenoxide. For preventing erosion in unfavorable application conditions and nevertheless maintaining a good electrical contact, it is advantageous when the electrically conductive parts, such as for example the connection contact of the insulation sleeve, are composed of non-corroding materials, for example high grade steel. Moreover, these materials can be coated, for example brass gilded, for improving the electrical contact.

In accordance with a further preferable embodiment of the present invention, in an electrical connecting element the clamping sleeve and the insulation sleeve can be secured by an arresting clamping from an inadvertent loosening, for example by screwing. The clamping sleeve can be provided with a projection near the outer thread on its outer side, which is insertable into a gap of the periphery of the arresting clamping ring, to produce an arresting connection between the clamping sleeve and the arresting clamping ring.

In accordance with a further preferable embodiment of the present invention, the arresting clamping ring during screwing of the clamping sleeve and the insulation sleeve with one another can overcome the projection by deformation when an arresting torque is exceeded. The projection is dimensioned so that during a further screwing of the both sleeves, it vanishes in the inner thread of the insulation sleeve and has no more alternating action with the arresting ring. The sleeves can be screwed without further resistance and the inserted wire is squeezed.

The insulation sleeve can be provided on its outer side with a peripheral bead and with at least one axially oriented web which forms an abutment for at least one arresting hook arranged on the inner side of the arresting clamping ring, when the clamping sleeve with the arresting clamping ring arrested with it is inserted into the insulation sleeve. The at least one arresting hook is non-releasably arrested over the peripheral bead and thereby prevents an unscrewing of the clamping sleeve and the insulation sleeve.

After mounting of the clamping sleeve and the insulation sleeve, the arresting clamping ring is used so that the insulation sleeve and the clamping sleeve no longer can turn relative to one another and therefore again release from one another. Preferably, the insulation sleeve have four axially oriented webs which form abutments for the four arresting hooks arranged on the clamping ring. Thereby it can be guaranteed that practically no rotary movement of the insulation sleeve relative to the clamping sleeve is possible.

The inventive electrical connecting element is easy to operate, it has a simple construction. It is small, it can be reliably mounted on a not insulated wire, and the user does not come into contact with the electrically conductive part of the wire, so that the inventive electrical connecting element is especially advantageous for use in the medical field, for example for connection of an external heart pace maker.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is a view showing another embodiment of a connecting contact of an insulation sleeve of the inventive connection element;

FIG. 4 is a view showing still a further embodiment of the connecting contact of the insulation sleeve of the inventive connection element;

DESCRIPTION OF THE PREFERRED EMBODIMENTS

Figure 1:
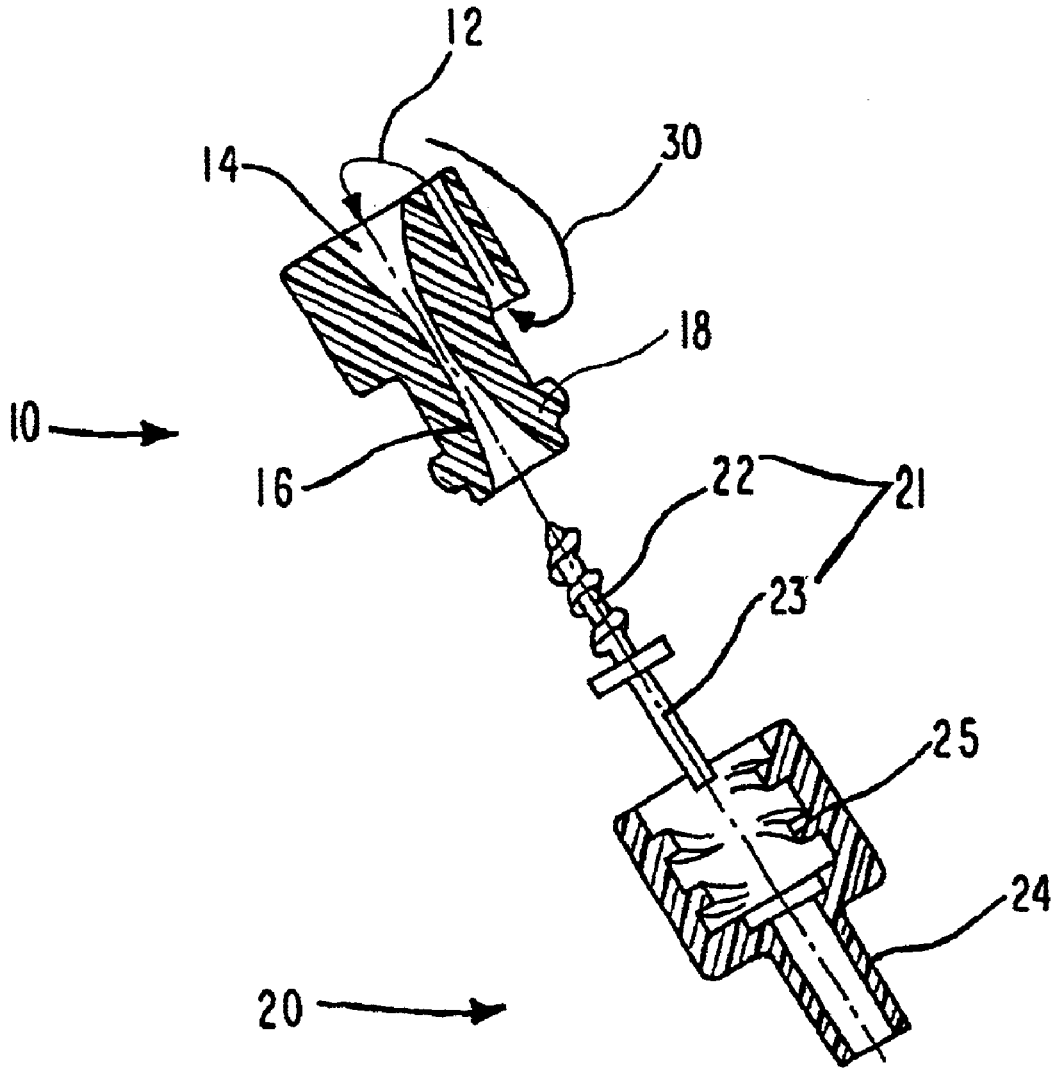
FIG. 1 is a schematic exploded view of a cross-section of an electrical connecting element in accordance with the present invention.

FIG. 1 shows schematically a cross-section of an inventive electrical connection element. For clear understanding of the individual elements of the connection element, they are shown on an exploded view. The electrical connection element in accordance with the present invention includes two parts, namely a clamping sleeve 10 and an insulation sleeve 20. An end of a wire 30 which must be connected to the connection element is inserted in the clamping sleeve. For this purpose the clamping sleeve 10 has an opening in which the wire 30 can be inserted. In the shown embodiment the opening is composed of a passage 12 and a funnel-shaped inlet 14, via which the wire 30 formed as a force unloading loop can be inserted. The clamping sleeve 10 has an expanding opening 16 at its end which faces the insulation sleeve 20. It is funnel-shaped also. The wire 30 later is firmly clamped in the opening 16. The wire 30 for this purpose must be inserted into the clamping sleeve 10 so that its end ends substantially at the end of the recess 16.

A squeezing contact element 22 of a connection contact 21 of the insulation sleeve 20 engages in the recess 16 of the clamping sleeve 10 when the clamping sleeve 10 and the insulation sleeve 20 are connected with one another. It clamps the end of the wire 30, as can be seen better from FIG. 2. The squeezing contact element 22 for this purpose has a shape with a forwardly reduced diameter, which is provided with edges. The squeezing contact element 22 in the shown embodiment is formed as a screw.

The connecting contact 21 of the insulation sleeve 20 additionally has a connection member 23 which is electrically connected with the squeezing contact element. The connection member 23 is formed here as a plug pin. A not shown plug bushing can be connected with the plug pin so as to connect the inventive connection element with further electrical wires, which can be used for example for connection of an external heart pacemaker. For preventing contact of the user with the electrical wire, the connection member 23 is preferably insulated from outside. The plug pin which serves here as the connection member 23 is simply guided in an outer sleeve 24.

The clamping sleeve 10 and the insulation sleeve 20 must be connected with one another. For this purpose the clamping sleeve 10 is provided with an outer thread 18, while the insulation sleeve 20 is provided with an inner thread 25, so that the both sleeves can be screwed with one another. Naturally other connections are also possible, such as for example a bajonet lock or an arresting connection.

Figure 2:
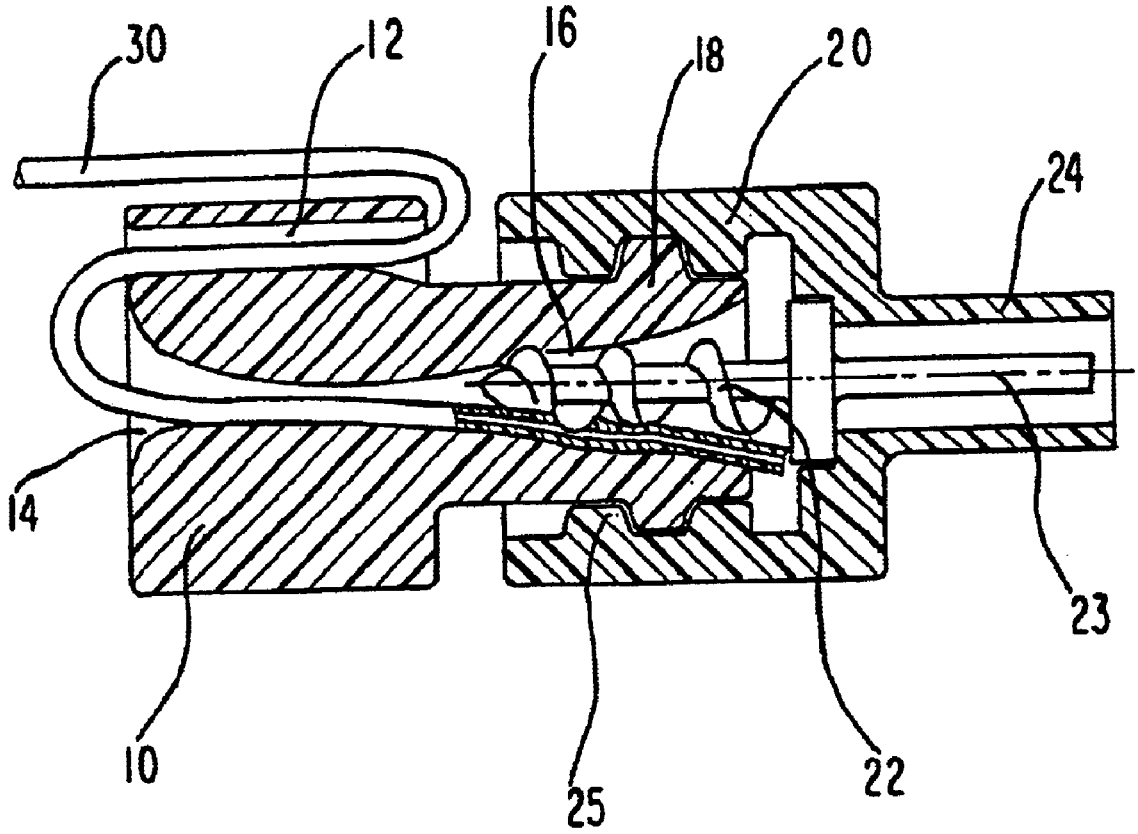
FIG. 2 is a view showing the inventive connection element of FIG. 1 in an assembled condition.

FIG. 2 schematically shows a cross-section of the connection element of the present invention shown in FIG. 1, in an assembled condition. The clamping sleeve 10 and the insulation sleeve 20 are here screwed with one another and thereby connected with one another. It can be seen that the end of the wire 30 is squeezed between the squeezing contact element 22 and the wall of the recess 16. The edges of the squeezing contact element 22 here the outer edges of the screw, displace simultaneously the insulation of the wire 30, so that an electrical contact between the wire 30 and the squeezing contact element 22 is produced, and the electrical wire 30 simultaneous is firmly held between the squeezing contact element 22 and the wall of the recess 16. At the right end of the insulation sleeve 20, it can be seen that the connection member 23 which is formed as a plug pin is located in its sleeve 24.

FIG. 3 shows another embodiment of the connecting contact 21 of the insulation sleeve 20. The squeezing contact element 22 of the connecting contact 21 is composed here of several disks 26 which are arranged at distances from one another. They have a diameter which reduces forwardly.

FIG. 4 shows still a further embodiment of the connecting contact 21 of the insulation 20. The squeezing contact element 22 of the connecting contact is composed of several cylinders 27 which are arranged one behind the other. The diameters of the cylinders 27 also reduce forwardly.

Figure 5:
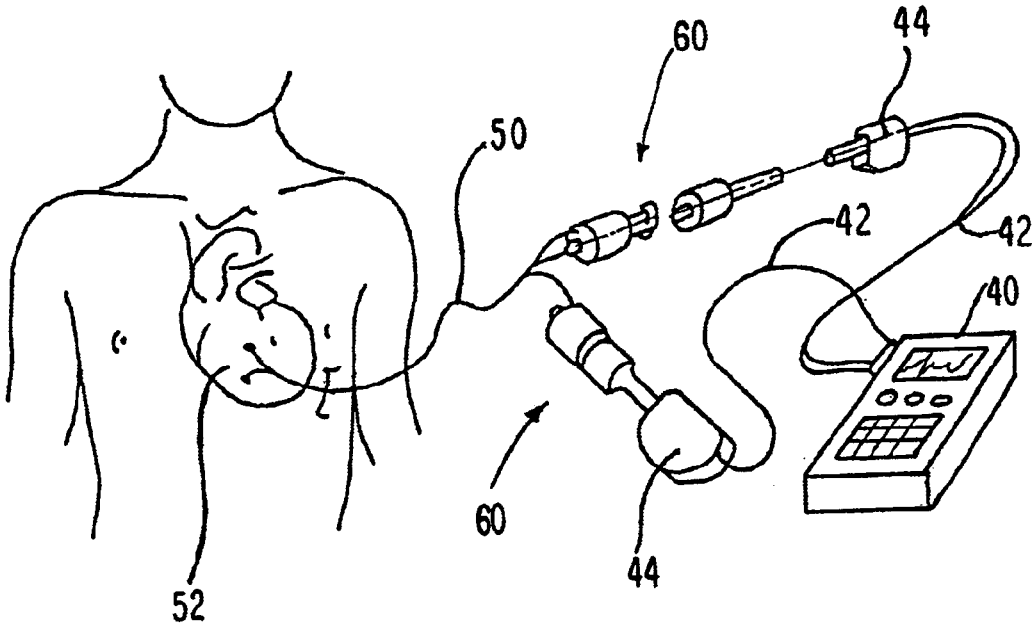
FIG. 5 is a view showing an example of the application of the inventive electrical connection element for connection of a heart pacemaker.

FIG. 5 finally shows the use of the inventive connection element for connection of an external heart pacemaker 40 to a heart wire, or in other words a wire 50 which is connected with the heart muscle 52 and extends outwardly beyond the body. The wire 50 is formed as a lead pair. The external heart pacemaker 40 has two connecting conductors 42 which are provided at their ends with plugs 44. The plugs are connected correspondingly with the connecting conductors 42 of both electrical connection elements 64 formed in accordance with the present invention. The upper inventive connection element 60 is shown in a disconnected position and a lower inventive connection element 60 is shown in the connected position.

Figure 6:
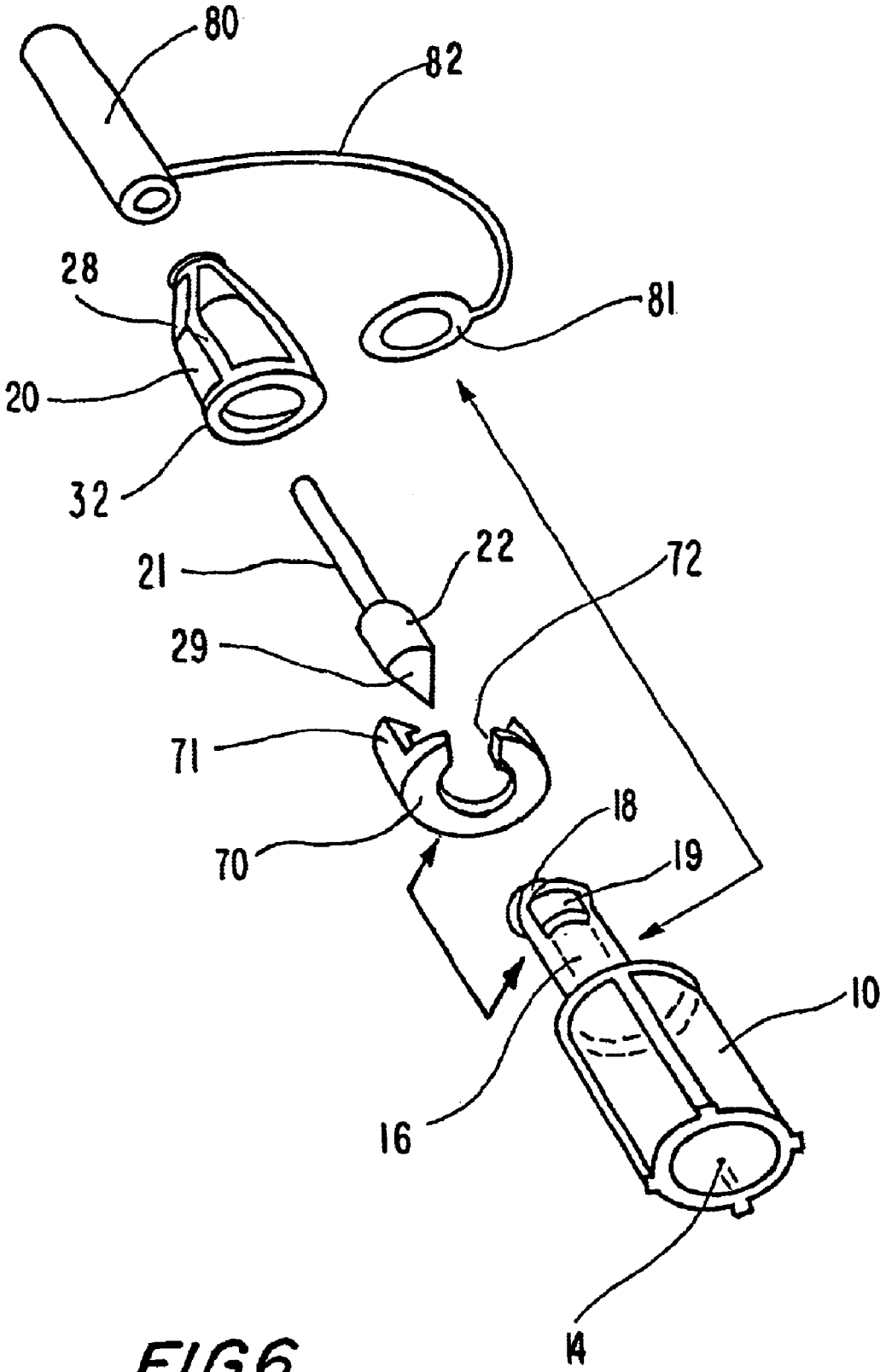
FIG. 6 is a perspective exploded view of a further embodiment of a connection element.

FIG. 6 shows the details of a further connection element in accordance with the present invention. All parts, with the exception of the connecting contact 22, are composed of a synthetic plastic, for example transparent heart polyvinyl chloride, polycarbonate, acrylonitrile butadiene styrene. Alternatively to the sleeve 24 of FIG. 4, here a contact protective cap 80 is provided for the connecting contact 21. For avoiding its loss it is connected via a connecting web 82 with a holding ring 81. For improved frictional clamping on the connecting contact 21, the contact protective cap 80 is composed of a soft material, such as for example PE or PP. When the connection element is used for connection to an external heart pacemaker, the protective cap 80 for marking the implantation position of a pacemaker electrode 30 can be colored to be recognized by the user. The holding ring 81 is displaced into the parts 10 over the outer surface of the funnel-shaped recess 16 for safety reasons. A projection 19 formed as a raised cylinder sector before the outer thread 18 is also provided on this outer surface. The height of the projection 19 is dimensioned so that, it corresponds to the radial thread gap between the outer thread 18 and the inner thread 25 shown in FIG. 7. Thereby the later screwing mounting is not negatively affected. The peripheral width of the projection 19 corresponds to the width of the gap 72 of an arresting clamping ring 70 for securing the parts 10 and 20.

Figure 7:
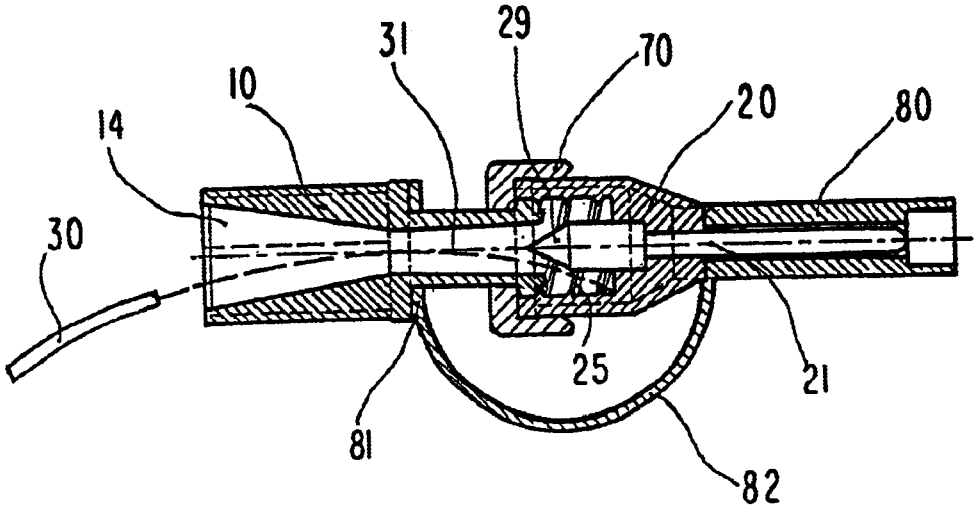
FIG. 7 is a view showing a longitudinal section of the connection element of FIG. 6 in a screwed-on condition and during insertion of a wire.
Figure 8:
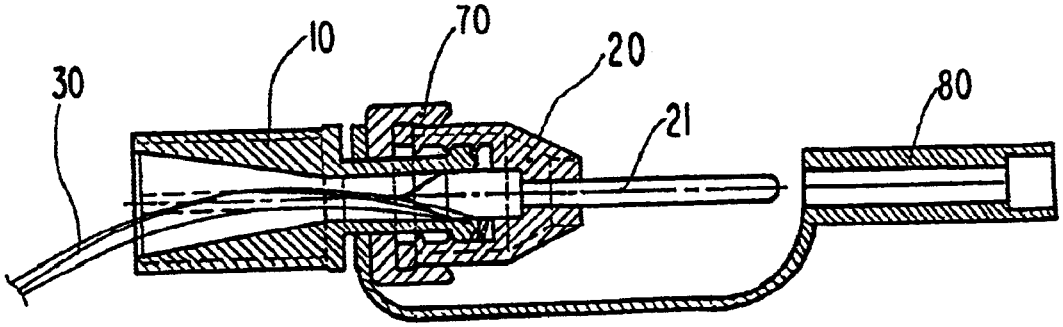
FIG. 8 is a view showing a longitudinal section through the connection element of FIG. 6 in the screwed-on condition after the mounting on the wire.

In order to assemble the connection element shown in FIGS. 7 and 8, first the clamping ring 70 is clipped on the outer surface of the recess 16. The projection 19 must be located in the gap 72. After the insertion of the connecting contact 21 into the insulation sleeve 20, the outer thread 18 is screwed into the first thread turn of the inner thread 25. Thereby the arresting hook 71 of the arresting clamping ring 70 engages over a peripheral bead 32 of the insulation sleeve 20. It can be located between axial webs 28 on the outer surface of the sleeve 20. The arresting clamping ring 70 prevents in this way an inadvertent unscrewing of the parts 10 and 22. The axial web 28 prevents via the arresting hook 71 a turning of the arresting clamping ring 70. After the displacement of the contact protective cap 80 on the connecting contact 21, the connection element is in condition ready to use, as shown in FIG. 7.

FIG. 7 also shows how a user displaces a wire, for example the extracarporeal end of an implanted heart pacemaker electrode 30, through the funnel-shaped inlet 14 on an insertion cone 29 of the connecting contact 21 along an insertion path 31. The projection 19 of the part 10 is urged in the gap 72 of the arresting clamping ring 70 as shown in FIG. 6 because of the and provides the rotation safety of the arresting clamping ring 70 for an easy screwing safety of the total configuration of the connecting plug. With this screwing safety it is guaranteed that the user after unpacking of the element always holds the connection element in its hands in screwed-on, assembled, mounting-ready condition. After the insertion of the wire 30 or the heart pacemaker electrode, with a force screwing of the both parts 10 and 20, the fixation by the projection 19 and the gap 72 is overcome, and finally the wire 30 is clamped and bared between the funnel-shaped recess 16 and the squeezing contact element 22 as shown in FIG. 6.

FIG. 8 shows the connected, operation-ready connection element. Before the insertion in a temporary heart pacemaker machine shown in FIG. 5, the contact protective cap 80 must be withdrawn from the connecting contact 21. In the embodiment of a connection element with a fixed sleeve 24 for contact projection shown in FIG. 1 and the available corresponding safety bushings on the temporary heart pacemaker, the contact protective cap 80 can be dispensed with.

It will be understood that each of the elements described above, or two or more together, may also find a useful application in other types of constructions differing from the types described above.

While the invention has been illustrated and described as embodied in electrical connecting element, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An electrical element for connecting an electrically insulated end of a wire, comprising a clamping sleeve in which an end of a wire is insertable and clampable; an insulation sleeve connectable with said clamping sleeve and provided with a connecting contact arranged so that, during a connection of said clamping sleeve with said insulation sleeve and said connecting contact of said insulation sleeve is brought into contact with an end of a wire with removal of an insulation of the wire; and an arresting clamping ring which connects said clamping sleeve with said insulation sleeve to prevent an unintentional loosening, said clamping ring having an inner side provided with at least one arresting hook, said insulation sleeve having an inner side provided with a peripheral bead and at least one axially oriented web which forms an abutment for said at least one arresting hook when said clamping sleeve together with said arresting clamping ring is screwed into said insulation sleeve, so that said at least one arresting hook is non-releasably arrestable over said peripheral bead and thereby prevents unscrewing of said clamping sleeve and said insulation sleeve.

2. An electrical connection element as defined in claim 1, wherein said arresting clamping ring has a periphery provided with a gap, said clamping sleeve having an outer side provided with an outer thread and also with a projection which adjoins said outer threat and is insertable into said gap.

3. An electrical connection element as defined in claim 1, whereni said arresting clamping is provided with a plurality of arresting hooks, said insulation sleeve being provided with a plurality of axially oriented webs which form abutments for said arresting hooks.

4. An electrical connection element as defined in claim 1, wherein said clamping sleeve has a recess, said connecting contact being insertable into said recess and having a squeezing contact element.

5. An electrical connection element as defined in claim 1, and further comprising a contact protective cap removably attachable to said connecting contact, and removable for insertion of the electrical connection element into an associated machine.

* * * * *